United States Patent [19]

Motsch

[11] Patent Number: 5,054,147

[45] Date of Patent: Oct. 8, 1991

[54] FABRICATION LAST FOR SHOE MANUFACTURE ON A COMPUTER-CONTROLLED TRANSFER LINE

[76] Inventor: Gerhard Motsch, Am Sommerwald 237, 6780 Pirmasens, Fed. Rep. of Germany

[21] Appl. No.: 468,562

[22] Filed: Jan. 23, 1990

[30] Foreign Application Priority Data

Jan. 24, 1989 [DE] Fed. Rep. of Germany ..... 8900722

[51] Int. Cl.[5] ..... A43D 3/00

[52] U.S. Cl. ..... 12/133 R; 12/135 R

[58] Field of Search ..... 12/135 R, 133 R, 135 A, 12/136 R, 136 A, 136 B, 136 C

[56] References Cited

U.S. PATENT DOCUMENTS

| | | | |
|---|---|---|---|
| 851,968 | 4/1907 | Turfant | 12/135 R |
| 909,388 | 1/1909 | Fitz | 12/136 C |
| 1,192,257 | 7/1916 | Alley | 12/135 R |
| 1,500,106 | 7/1924 | Cavanagh | 12/135 A X |
| 2,037,915 | 4/1936 | Messmer | 12/133 R |
| 2,062,557 | 12/1936 | Clark | 12/133 R X |
| 2,111,512 | 3/1938 | Naceski | 12/133 R |
| 2,684,493 | 7/1954 | Clausing | 12/136 R |
| 2,806,233 | 9/1957 | Hubbard et al. | 12/133 R |
| 3,076,213 | 2/1963 | Makovski et al. | 12/133 R |
| 4,286,348 | 9/1981 | White, Sr. | 12/133 R |

FOREIGN PATENT DOCUMENTS 3804583 of 0000 Fed. Rep. of Germany .

*Primary Examiner*—Paul T. Sewell
*Assistant Examiner*—Beth Anne Cicconi
*Attorney, Agent, or Firm*—Toren, McGeady & Associates

[57] ABSTRACT

A fabrication last (10) for shoe manufacture on a computer-controlled transfer line comprises a toe part (11) and a heel part (12) which are displaceable relative to one another. The two last parts (11, 12) are held together by means of a lock (20). The latter comprises a flat metal part (21), which is fixed in one of the last parts (12) by means of screws (29), and an elongated hole (22) which extends between the two last parts (11, 12) substantially parallel to the sectional area (13). A stepped bore hole (14), in which a fork (23) is guided, is provided in the other last part (11). This fork (23) comprises a fork head (23.1) whose two sides overlap the flat metal part (21). A transverse pin (24) which engages through the elongated hole (22) and in this way holds together the two last parts (11, 12) is supported in the fork head (23.1). A two-piece receiving plate (30.1, 30.2) serves to fix the last (10) at the work stations of the transfer system. In order also to ensure a secure and permanent adjustment of the receiving plate (30.1, 30.2) in the last (10) comprising plastic, a bore hole (31.1, 31.2) is inserted in each instance into the last parts (11, 12) below and parallel to the receiving plate (30.1, 30.2). These bore holes (31.1, 31.2) comprise in each instance a metal part (32.1, 32.2) which is provided with threaded bore holes (34). The fastening screws (33.1, 33.2) of the receiving plate (30.1, 30.2) engage in these threaded bore holes (34).

22 Claims, 2 Drawing Sheets

FABRICATION LAST FOR SHOE MANUFACTURE ON A COMPUTER-CONTROLLED TRANSFER LINE

DESCRIPTION

The invention is directed to a fabrication last for shoe manufacture on a computer-controlled transfer line which is outfitted with robots and automatic processing machines.

At present, two types of fabrication last are commonly used in shoe manufacturing: the sliding last and the folding last. They comprise a toe part and a heel part which are coupled with one another by means of a hinge so as to be movable. A spring which is built into the hinge ensures that the heel and toe parts occupy a fixed position relative to one another in the closing position of the last.

The reason for the hinge consists in shortening the effective last length by means of the relative movement of the last parts in order to remove the last from the finished shoe.

In order to move the two last parts relative to one another with the aid of the hinge, considerable forces are required in order to overcome the force of the built-in spring. However, the high spring force is necessary in order to achieve a sufficiently stable holding of the two last parts in the closing position of the last.

As a further disadvantage, only a relatively slight shortening of the effective last length can be achieved in the commercially available hinge construction. This is sufficient for removing the last from the finished shoe manually. But it is not sufficient for carrying out this work with simple mechanical devices or also automatic handling devices as are used in modern computer-controlled manufacturing lines (DE-A- 38 04 538).

In order to ensure a frictionless flow in such manufacturing lines, the lasts must also be accurately positionable and adjustable. However, this is not possible with plastic lasts, which are commonly used, since these plastics tend to creep.

Finally, it should be noted that lasts having different heights are used for the production of low shoes on the one hand and boots on the other hand, which results in doubled storage.

Therefore, the present invention has the object of providing a fabrication last which is suitable for use in computer-controlled transfer lines, allows a greater shortening of the effective last length with the use of smaller actuating forces without overstretching the shoe, permits an accurate adjustment of the detachable connecting members and can easily be adapted to boot manufacture.

This object is met by means of a last, according to the generic type, with the characterizing features of the present invention.

The substantial advantages of this construction consist in that the effective last length can be shortened practically to a desired degree in that the length of the elongated hole or elongated groove, respectively, can be adjusted as desired in connection with the inclination of the sectional area between the two last parts, which is likewise selectable as desired in principle, but in that the actuating force itself is selected independently of the latter and can be adjusted only by means of the strength of the spring, and in that the locking construction is simple, inexpensive and reliable in operation.

Plastic lasts are often used in the manufacture of shoes. If the connecting members responsible for the detachable positioning of the last at the individual processing stations of the transfer line are screwed together with the plastic, they change their position in an uncontrollable manner due to the plastics characteristics. This results in operating trouble. However, this can be prevented if the lasts are developed according to the features of present invention.

In order that the lasts which are intended in the first place for the fabrication of low shoes can also be used in the production of boots, the use of a separate boot construction, is recommended.

Other constructions of the invention follow from the subclaims in connection with the following description of embodiment examples.

Figure 1:
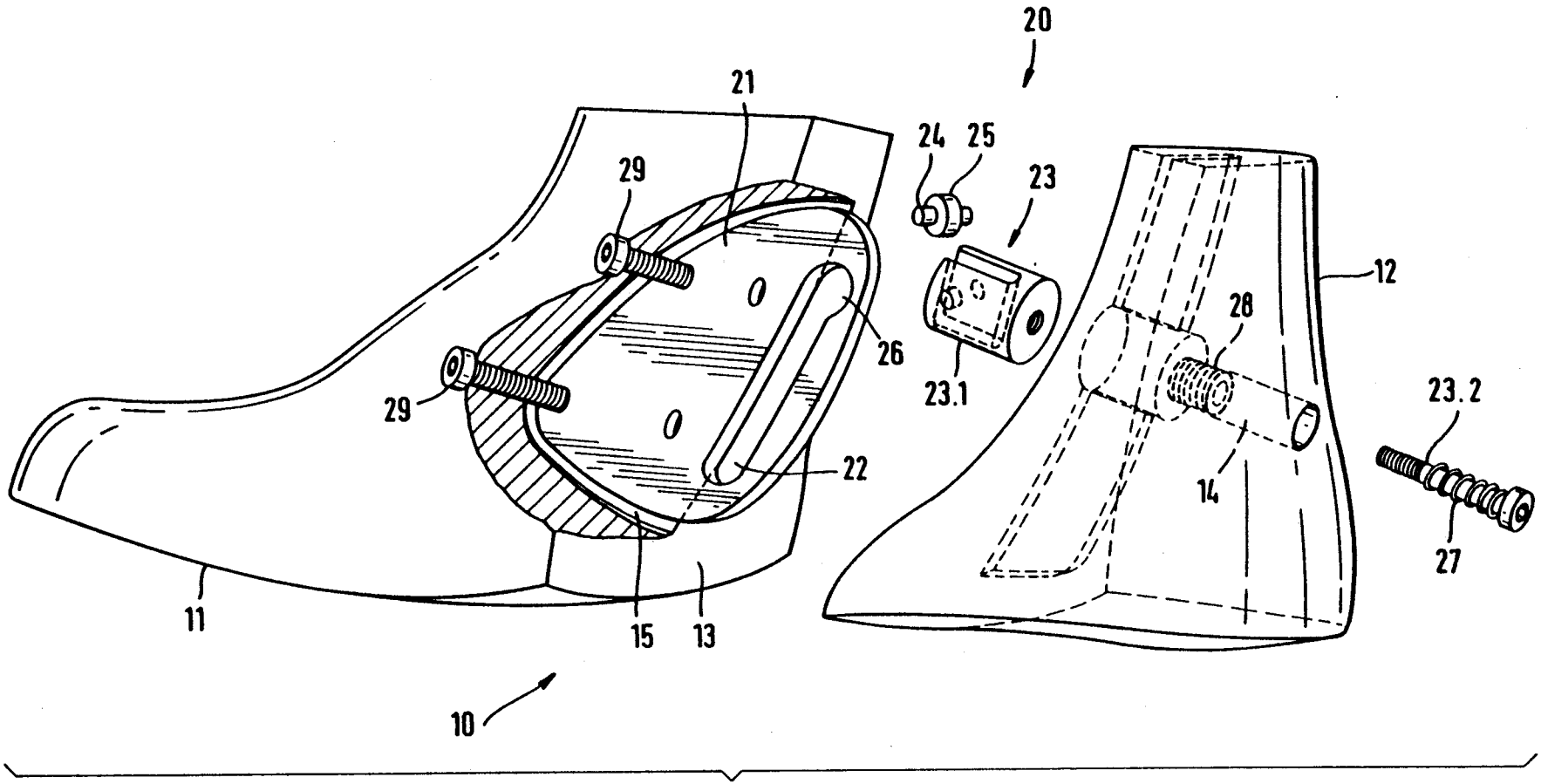
FIG. 1 shows a partially expanded perspective view of a last, according to the invention, as an exploded diagram.

A fabrication last 10 comprising a toe part 11, a heel part 12 and a lock 20 can be seen in FIG. 1. The sectional area between the two last parts 11, 12 is designated by the reference number 13. The toe part 11 of the last 10 comprises a vertical, recessed groove 15 in the area of the sectional area 13. A flat metal part 21 is fastened in this recessed groove 15 by means of screws 29. The flat metal part 21 comprises an elongated hole 22 which extends substantially parallel to the sectional area 13. The elongated hole 22 comprises a catch groove 26 at its upper end which brings about the subsequent closing position of the last 10.

A stepped bore hole 14 is provided in the heel part 12 of the last 10. A fork 23 is guided in this stepped bore hole 14.

The fork 23 comprises a fork head 23.1, whose two sides overlap the flat metal part 21. A transverse pin 24, on which a roller 25 is fastened so as to be rotatable, is supported in the fork head 23.1. The transverse pin 24 with roller 25 engages through the elongated hole 22 and holds the two last parts 11, 12 together in this way. The roller 25 runs along the wall of the elongated hole 22 when the two last parts 11, 12 are moved relative to one another.

Of course, the elongated hole 22 and the transverse pin 24 can be replaced by two elongated grooves in which a transverse pin engages in each instance.

The shaft 23.2 of the fork 23 carries a coil spring 27 which is supported against a metal sleeve 28 screwed into the stepped bore hole 14.

In the present embodiment example, the spring 27 is constructed as a pressure spring. If a tension spring were used, the catch groove 26 in the elongated hole 22 would have to be constructed on the other side.

Of course, the flat metal part 21 can also be supported in a resilient manner as an alternative.

The elongated hole 22 and fork 23 are approximately perpendicular to one another. In this way, the force needed for displacing the last parts 11, 12 is minimal after overcoming the catch position; however, the holding force of the last parts 11, 12 relative to one another is maximal.

Figure 2:
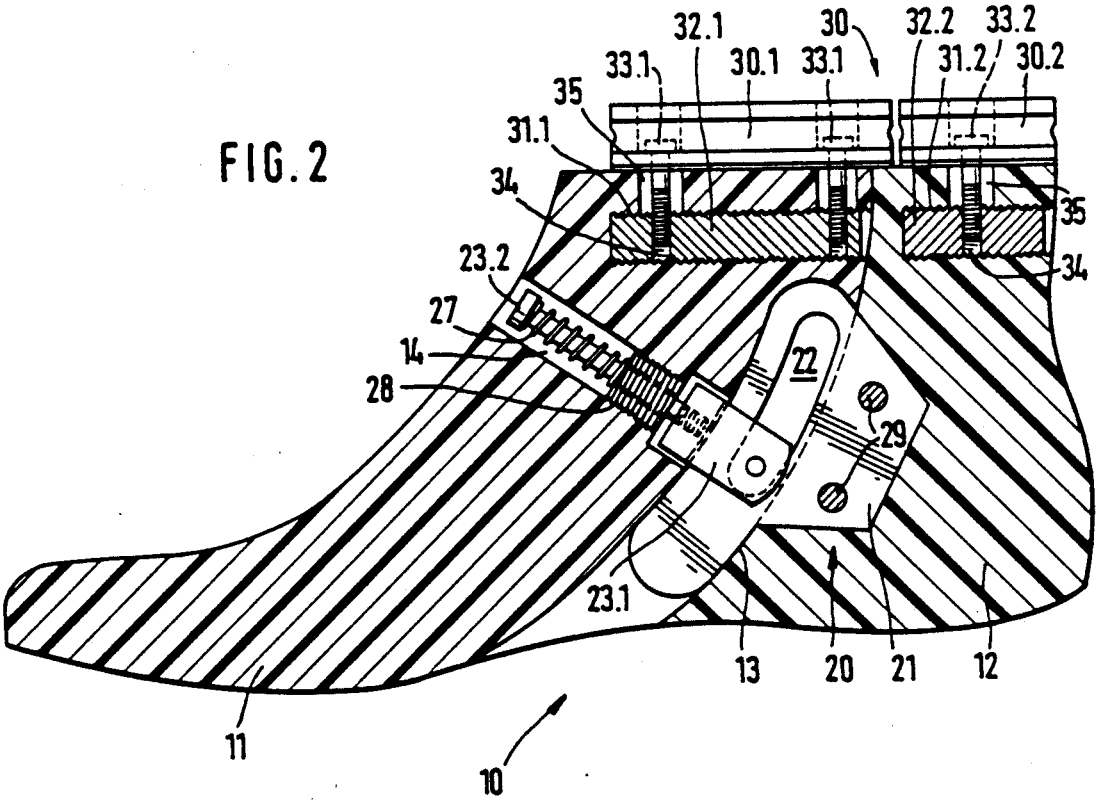
FIG. 2 shows a schematic side view of another embodiment form of a last.

FIG. 2 shows an embodiment form in which the flat metal part 21 is supported in the heel part 12 and the fork 23 is supported in the toe part 11 of the last 10. The advantage of this embodiment form consists in that the shaft 23.3 of the fork 23 is also accessible when a shoe shank is lasted.

A two-piece receiving plate 30.1, 30.2 is fastened on the toe part 11 and heel part 12 of the last 10. This receiving plate 30 serves for the detachable connection of the last 10 with the respective processing station of the transfer line. In order to ensure an unobjectionable flow of operation on the transfer line, the receiving plate 30 must be exactly positioned. If the last 10 comprises plastic, as is often the case, the required accuracy of the adjustment of the receiving plate 30 cannot be ensured in the long run, since the plastics used for the production of lasts 10 tend to creep. For this reason, a bore hole 31.1, 31 2 is inserted in both the toe part 11 and the heel part 12 below and parallel to the receiving plate 30. A metal part 32.1, 32.2, in this instance in the form of a rod having fine threads, is inserted into these bore holes 31. The metal part 32.1, 32.2 comprises transversely extending threaded bore holes 34. Connection bore holes 35 with a relatively large cross section are inserted in the area of the threaded bore holes 34 underneath the receiving plate 30. The fastening screws 33.1, 33.2 are inserted through the latter and screwed into the threaded bore holes 34 of the metal parts 32.1, 32.2.

Figure 3:
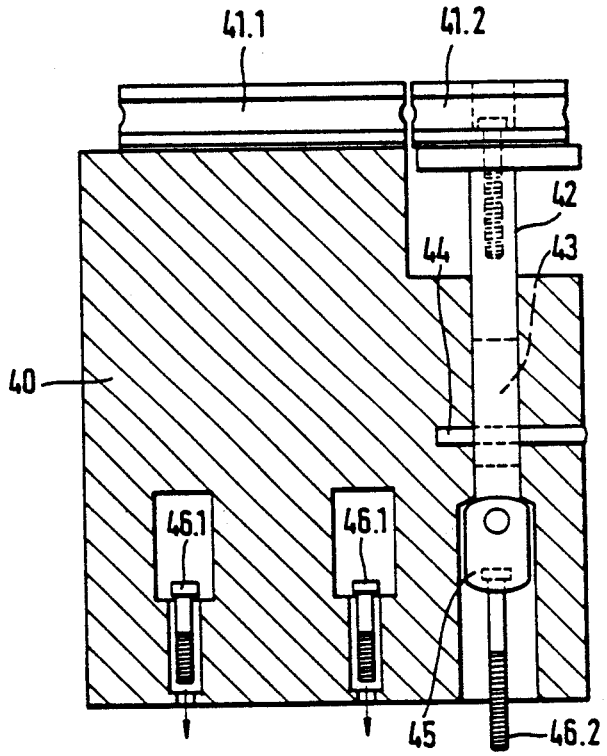
FIG. 3 shows a schematic side view of a boot construction to be used as needed.

FIG. 3 shows a boot construction as is used when boots are to be produced on the transfer line instead of low shoes.

The boot construction 40 comprises a metal body, preferably of aluminum. It is screwed together with the last 10 instead of the receiving plate 30. A comparable receiving plate 41.1 is screwed on to its upper side. Since the boot construction 40 comprises metal, the one-time adjustment of the receiving plate 41.1 for the boot construction 40 remains unchangeable.

The rear part 41.2 of the receiving plate 41 is screwed together with a connecting pin 42. This is supported in a bore hole of the boot construction 40 so as to be longitudinally movable. In order to achieve protection against rotation, the connecting pin 42 comprises an elongated slot 43 through which a transverse pin 44 is inserted.

A swivel bearing 45 can be seen at the lower end of the connecting pin 42; a connecting screw 46.2 which is screwed together with the heel part 12 of the last 10 acts at the swivel bearing 45. The last 10 can accordingly be opened and closed via the rear part 41.2 of the receiving plate 41. Moreover, the boot construction 40 is screwed together with the toe part 11 of the last 10 by means of connecting screws 46.1.

Finally, it should be noted that the sectional area 13 between the two last parts 11, 12 can receive practically any desired angular position and curved shape. In all cases, it need only be ensured that the elongated hole 22 extends substantially parallel to the sectional area 13.

I claim:

1. Fabrication last (10) for use in shoe manufacture on a computer-controlled transfer line outfitted with robots and automatic processing machines, with the fabrication last extending in a first direction and comprising a toe part (11) and a following heel part (12) in the first direction connected together by a lock (20) whereby the toe and heel parts are movable relative to one another, and a two-piece receiving plate (30) extending in the first direction and adapted for detachable connection of the last (10) with transfer line, robots and processing machines, wherein the improvement comprises that a generally upwardly extending sectional area (13) extending transversely of the first direction defines contacting surfaces of said toe and heel parts (11, 12), the lock (20) comprises a flat metal part (21) fixed in one of the toe and heel parts (11; 12) and extending in the first direction into the other one of said toe and heel parts, the metal part (21) comprises a closed ended elongated hole (22) extending substantially parallel to the sectional area (13) and located in a portion of the metal part extending into the other one of said toe and heel parts, a fork (23) is supported in the other one of the toe and heel parts (12; 11), said fork (23) comprises a bifurcated head (23.1) overlaping the portion of said flat metal part (21) extending into the other one of said toe and heel parts, at least one transverse pin (24) mounted in the head (23.1) of the fork (23), and said transverse pin (24) extends through the elongated hole (22), and one of the metal part (21) or the fork (23) is resiliently supported.

2. Fabrication last according to claim 1, wherein a roller (25) is fastened on the transverse pin (24) so as to be rotatable in said hole (22).

3. Fabrication last according to claim 1, wherein the elongated hole (22) comprises at least one catch groove (26) which fixes the closed position of the last (10).

4. Fabrication last according to claim 1, wherein a coil spring (27) is wound around a shaft (23.2) of the fork (23).

5. Fabrication last according to claim 1, wherein a metal sleeve (28) is screwed into a bore hole (14) in the other one of said toe and heel parts which receives the shaft (23.2) of the fork (23).

6. Fabrication last according to claim 1, wherein the flat metal pat (21) is screwed to the one of said toe and heel parts (11; 12).

7. Fabrication last according to claim 1, wherein the elongated hole (22) and fork (23) are approximately perpendicular to one another.

8. Fabrication last according to claim 1, wherein the flat metal part (21) is fixed in the toe part (11), the fork (23) is resiliently supported in the heel part (12).

9. Fabrication last for use in shoe manufacture on a computer-controlled transfer line outfitted with robots and automatic processing machines, with the fabrication last extending in a first direction and comprising a toe part (11) and a following heel part (12) in the first direction connected together by a lock (20) whereby the toe and heel parts are movable relative to one another, and a two-piece receiving plate (30) extending in the first direction located above said last (10) and adapted for detachable connection of the last (10) with transfer line, robots and processing machines, wherein the improvement comprises that the last (10) comprises plastic, a bore hole (31) is inserted in each instance in the toe and heel parts (11, 12) at a distance below the receiving plate (30) and approximately parallel to the latter, a metal part (32) with vertically directed threaded bore holes (34) is inserted into each of these bore holes (31), connection holes (35) with enlarged cross section are inserted into the last (10) from the receiving plate (30) to the threaded bore holes (34), and the fastening screws (33) for the receiving plate (30 are inserted through these connection holes (35).

10. Fabrication last according to claim 9, characterized in that the metal parts (32) are fine-threaded rods.

11. Fabrication last for use in shoe manufacture on a computer-controlled transfer line outfitted with robots and automatic processing machines, with the fabrication last extending in a first direction and comprises a toe part (11) and a following heel part (12) in the first direction connected together by a lock (20) whereby the toe and heel parts are movable relative to one another, wherein the improves comprises a boot construction (40) is provided which can be placed on the last (10), a connecting pin (42) is elongated transversely of the first direction and is guided in the boot construction (40) in an area of the heel part (12) so as to be movable in the elongated direction of the connecting pin, and the connecting pin (42) comprises an articulation (45) at an end of said connecting pin closer to said last.

12. Fabrication last according to claim 11, wherein the boot construction comprises metal.

13. Fabrication last according to claim 11 or 12, characterized in that the connecting pin (42) comprises an elongated slot (43) through which a pin (44) is inserted to ensure against rotation.

14. Fabrication last according to claim 12, wherein the boot construction comprises aluminum.

15. Fabrication last (10) for use in shoe manufacture on a computer-controlled transfer line outfitted with robots and automatic processing machines, with the fabrication last extending in a first direction and comprising a toe part (11) and a following heel part (12) in the first direction connected together by a lock wherein the toe and heel parts are movable relative to one another, and a two-piece receiving plate (30) extending in the first direction and adapted for detachable connection of the last (10) with transfer line, robots and processing machines, wherein the improvement comprises that a generally upwardly extending sectional area (13) extending transversely of the first direction defines contacting surfaces of said toe and heel parts (11, 12), a lock (20) comprises a flat metal part (21) fixed in one of the toe and heel parts (11, 12) and extending in the first direction into the other one of said toe and heel parts, the metal part (21) comprises a closed ended elongated groove extending substantially parallel to the sectional area (13) and located in a portion of the metal part extending into the other one of said toe and heel parts, a fork (23) is supported in the other one of the toe and heel parts (12, 11), said fork (23) comprises a bifurcated head (23.1) overlapping the portion of said flat metal part (21) extending into the other one of said toe and heel parts, at least one transverse pin (24) mounted in the head (23.1) of the fork (23), and said transverse pin (24) engages in the elongated groove, and one of the metal part (21) or the fork (23) is resiliently supported.

16. Fabrication last according to claim 15, wherein a roller (25) is fastened on the transverse pin (24) so as to be rotatable in the elongated groove.

17. Fabrication last according to claim 15, wherein the elongated groove comprises at least one catch groove (26) which fixes the closed position of the last (10).

18. Fabrication last according to claim 15, wherein a coil spring (27) is wound around a shaft (23.2) of the fork (23).

19. Fabrication last according to claim 15, wherein a metal sleeve is screwed into a bore hole (14) in the other one of said toe and heel parts (11, 12) which receives the shaft (23.2) of the fork (23).

20. Fabrication last according to claim 15, wherein the flat metal part (21) is screwed to the one of said toe and heel parts (11, 12).

21. Fabrication last according to claim 15, wherein the elongated groove and fork (23) are approximately perpendicular to one another.

22. Fabrication last according to claim 15, wherein the flat metal part (21) is fixed in the toe part (11), and the fork (23) is resiliently supported in the heel part (12).

* * * * *